US007948446B2

(12) United States Patent
Barone

(10) Patent No.: US 7,948,446 B2
(45) Date of Patent: May 24, 2011

(54) XYZ ISOTROPIC RADIATOR ANTENNA

(76) Inventor: James V. Barone, Millersville, MD (US)

( * ) Notice: Subject to any disclaimer, the term of this patent is extended or adjusted under 35 U.S.C. 154(b) by 0 days.

(21) Appl. No.: 12/702,607

(22) Filed: Feb. 9, 2010

(65) Prior Publication Data

US 2011/0068997 A1 Mar. 24, 2011

Related U.S. Application Data

(63) Continuation-in-part of application No. 11/480,737, filed on Aug. 9, 2006, now abandoned.

(51) Int. Cl.
*H01Q 9/30* (2006.01)

(52) U.S. Cl. ..... 343/900; 343/715; 343/893

(58) Field of Classification Search ..... 343/715, 343/893, 900
See application file for complete search history.

(56) References Cited

U.S. PATENT DOCUMENTS

| | | | | |
|---|---|---|---|---|
| 2,835,548 | A * | 5/1958 | Baumann | 312/352 |
| 6,774,863 | B2 * | 8/2004 | Shirosaka et al. | 343/797 |
| 7,321,340 | B1 * | 1/2008 | Sergi et al. | 343/890 |
| 2007/0109213 | A1 * | 5/2007 | Takahashi | 343/893 |
| 2010/0001922 | A1 * | 1/2010 | Yun et al. | 343/879 |

* cited by examiner

*Primary Examiner* — Tan Ho

(57) ABSTRACT

An XYZ isotropic radiator antenna is characterized by three whip antennas connected with a housing and arranged 90 degrees perpendicular to each other. The antenna generates a heliocentric spherical radiation pattern which allows the antenna to transmit and receive radio frequency signals in any direction or plane.

7 Claims, 2 Drawing Sheets

XYZ ISOTROPIC RADIATOR ANTENNA

This application is a continuation-in-part of U.S. patent application Ser. No. 11/480,737 filed Aug. 9, 2006.

BACKGROUND OF THE INVENTION

Antennas are used to transmit and receive various types of radiation, including radio frequency (RF) energy such as is used in the transmission of communications and the like. A monopole antenna is an antenna having a single pole. The most common type of monopole antenna is an end driven whip antenna which operates as a quarter wave monopole. The radiation pattern generated by a monopole antenna is rather limited which in turn limits the efficiency of the antenna.

In the late nineteenth century, Heinrich Rudolph Hertz developed a dipole antenna. It includes a center driven element for transmitting and receiving radio frequency energy. Because antennas have no active components, they do not amplify RF energy or increase the overall signal levels of a radio transmission device. Rather, plane wave antennas such as dipole antennas direct or focus the radiated RF energy into a specific pattern. The dipole antenna generates an omnidirectional doughnut-shaped plane wave pattern.

While monopole and dipole antennas operate satisfactorily, they are limited in the type of radiation patterns that they produce which restricts their ability to send and receive signals in all directions. The present invention was developed in order to overcome these drawbacks by providing an isotropic radiator antenna which transmits an XYZ isotropic radiator polarization type wave that has an isotropy radiation pattern.

SUMMARY OF THE INVENTION

Accordingly, it is a primary object of the present invention to provide an isotropic radiator antenna including a housing having lateral, longitudinal and vertical axes each of which is arranged 90 degrees perpendicular to each other and a plurality of whips connected with said housing. More particularly, three whips are provided which extend along the lateral, longitudinal and vertical axes, respectively. The whips include conductors which are connected within the housing to produce an RF output signal. Each of the whips is an end driven element which generates a radiation pattern in the shape of a toroid which is spaced from the housing. The length of the whips is determined by the resonance of the antenna when the antenna is in a state of electrical balance. Collectively, the whips of the antenna generate a radiation pattern having a heliocentric spherical configuration with a directivity of one. The center of the pattern is arranged within the housing where the whip conductors are connected.

The whips are connected with the housing via RF connectors. The connectors are arranged in the top, side, and end walls of the housing. A further RF connector is connected with the other end wall of the housing and has a shielded cable connected therewith for connection with a transceiver. In transmission mode, the transceiver acts as a single feed source for the antenna. The antenna transmits a three-dimensional polarization type radiation pattern from a point source. In receiving mode, the antenna delivers an output RF signal to the transceiver.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
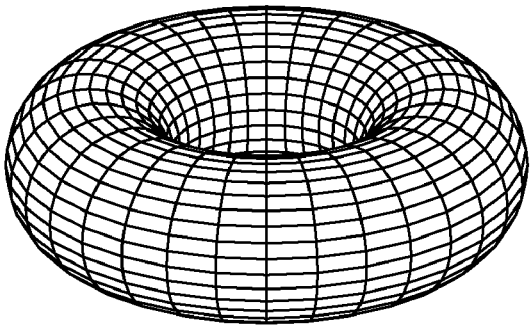
FIG. 1 is an illustration of a three-dimensional radiation pattern generated by a dipole antenna.

Referring first to FIG. 1, there is shown the doughnut shaped or toroidal three-dimensional radiation pattern generated by a dipole antenna. Such a pattern has limited focus and thus must be directed either to a source or target in order to achieve satisfactory transmission and receiving results.

Figure 2:
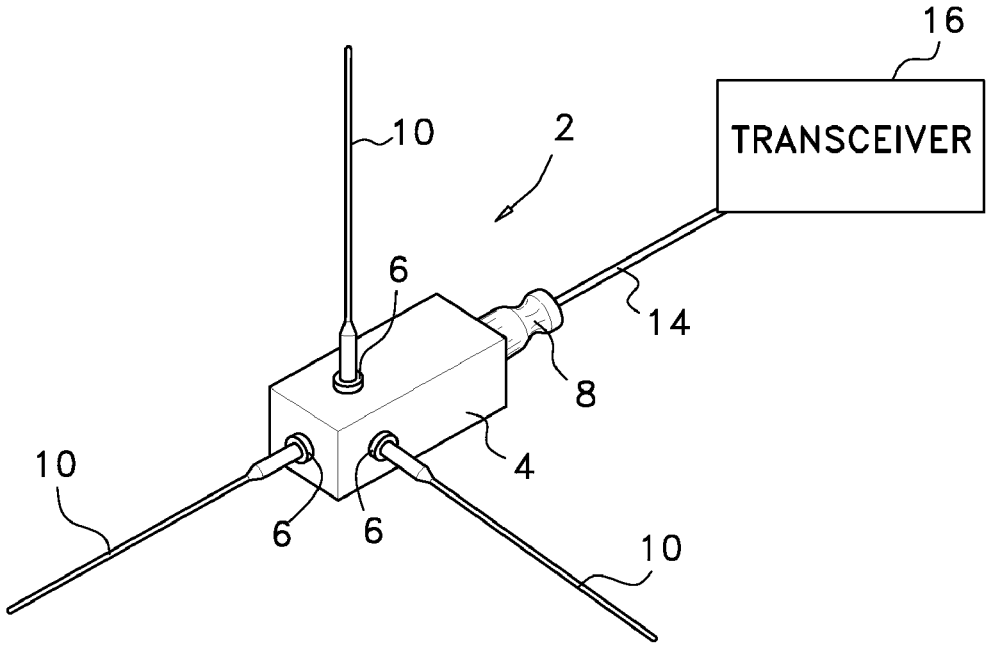
FIG. 2 is a perspective view of an XYZ isotropic radiator antenna according to the invention.
Figure 3:
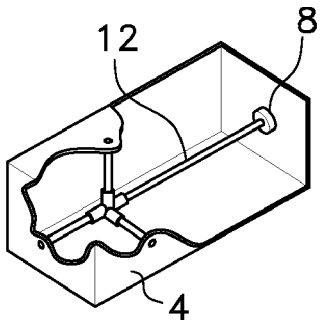
FIG. 3 is a partial sectional view of the housing for the antenna of FIG. 2.

Turning now to FIGS. 2 and 3, the isotropic radiator antenna 2 according to the invention will be described. The antenna includes a housing 4 which preferably has a rectangular configuration including top, bottom, front, rear and side walls. A suitable housing is a shielded box such as a Pomona 2391 box. The box has female BNC connectors 6 on the front, top, and one of the side walls thereof. An additional connector 8 is provided on the rear wall for the antenna output. Three identical metal elements 10 are connected with the BNC connectors 6. Each metal element is preferably a whip such as Strap-3 BNC 40 inch telescopic whip manufactured by Russell Industries. Accordingly, the whips 10 are arranged at 90 degrees from each other and extend in the X, Y, and Z directions relative to the housing.

As shown in FIG. 3, the ends of the connectors 6 are connected together within the housing so that RF signals received by the antenna elements are conducted into the box where they are combined and delivered via a wire 12 to the connector 8. A shielded coaxial cable 14 is delivers the RF signals from the housing output connector 8 to a transceiver 16 (FIG. 2) which comprises a receiver when the antenna is in receiving mode. The shielded cable protects against RF energy leakage into the transceiver front end components. In the transmission mode, the transceiver acts as a feed source which delivers a signal via the coaxial cable 14 to the connector 8 on the housing 4 and the antenna transmits signals in any direction from the point source within the housing where the connectors 6 are joined.

Figure 4:
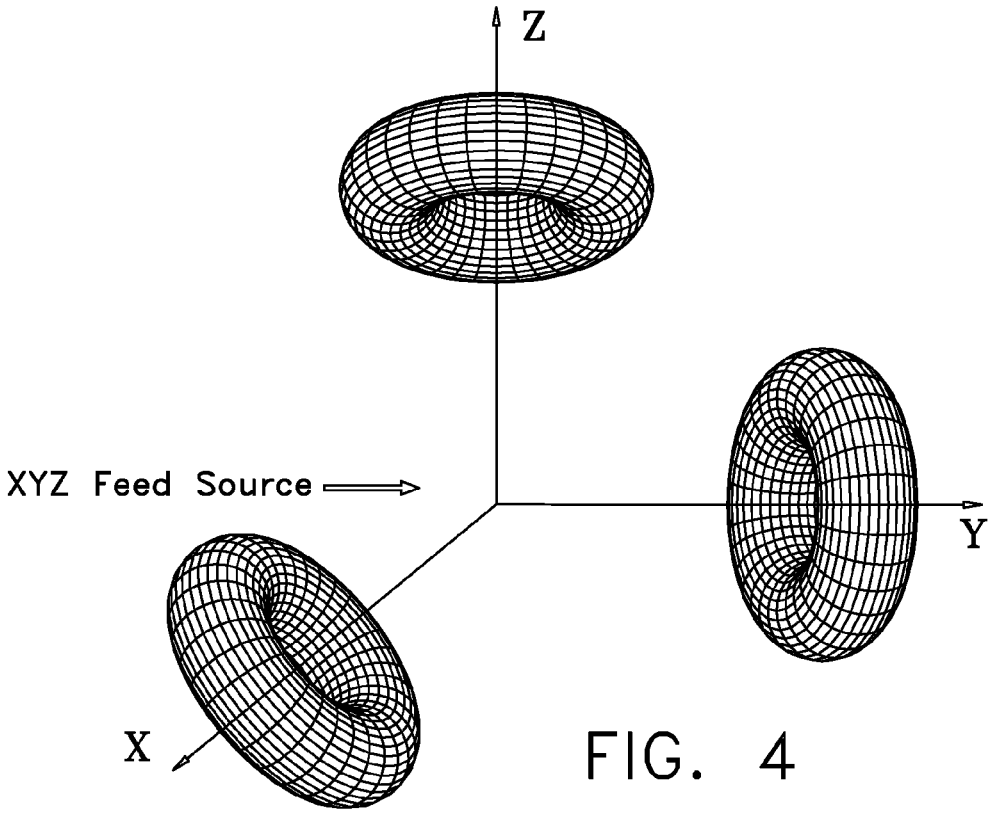
FIG. 4 is an illustration of the individual radiation patterns generated by the whips of the antenna of FIG. 2.
Figure 5:
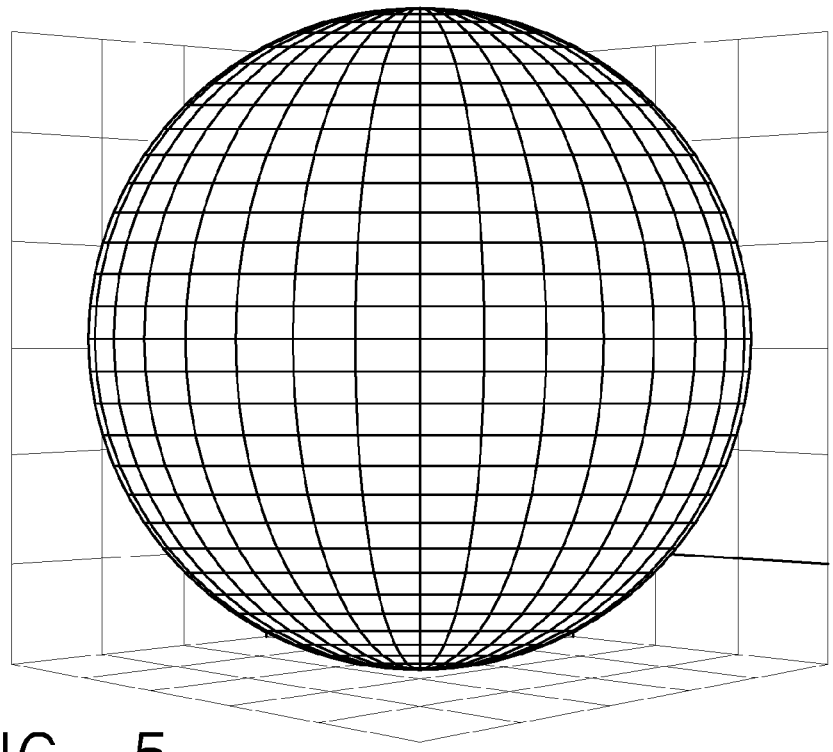
FIG. 5 is an illustration of the heliocentric spherical radiation pattern resulting from the combination of patterns shown in FIG. 4.

FIG. 4 is an illustration of the three electromagnetic fields from one feed source of an XYZ isotropic radiator antenna according to the invention. The XYZ electromotive force of the antenna of FIG. 2 has a continuous orthogonal vector field. It is perpendicular to the surface of the sphere, so the field never falls to zero on the sphere. The three fields X, Y, and Z of FIG. 4 all add together in spacetime and radiate one sphere of force as shown in FIG. 5. This is an atom size instantaneous spherical shape XYZ electromotive force at the point source which is within the housing where the connectors are joined. The sphere starts at the point source and radiates outwardly in an XYZ isotropic radiator polarization type wave into endless isotropy spacetime at the speed of light.

The antenna resonance of the XYZ isotropic radiator antenna of FIG. 2 is the RF in MHz where the antenna is in a state of electrical balance, and this determines the length of the X, Y, and Z elements perpendicular to each other. In the example shown using the Strap-3 BNC 40 inch telescopic whips, the antenna is 58 MHz at antenna resonance. Using the following formula $$V \div F \times 12 = \text{wavelength} \times (XYZ \text{ factor}) = XYZ \text{ (inches)}$$

where V (fps) is velocity and F (MHz) is the antenna resonance. For a velocity of 1000 and a resonance of 58, then $$1000 \div 58 \times 12 = 206.896 \times 0.19333 = 40 \text{ inches for } X, Y, \text{ and } Z.$$

The XYZ factor would be in the range of 5-20% of antenna resonance wavelength and is dependent on the specific element hardware, length and size of point source and feed source connector hardware used to construct the antenna. Alternate connectors such as SMA, type-N and elements made with solid and stranded wire and semi-rigid 141 cable could also be used to construct the XYZ isotropic radiator antenna according to the invention.

The XYZ isotropic radiator antenna transmits and receives with a new XYZ polarization type. The three 90 degree phased RF fields (FIG. 4) form into one heliocentric sphere shaped radiation pattern (FIG. 5) with a directivity of one. Each whip provides a doughnut shape pattern and is ⅓ of an isotropic radiator. The three whips positioned 90 degrees perpendicular to each other fill the pattern holes and provide for equal distance radius energy, i.e. field strengths, in all directions from the center of a radiation XYZ antenna. Some distortion of the pattern may appear near the ground and the coaxial cable feed source.

The XYZ antenna is used with a short coaxial cable 14 to the transceiver 16 or to a power meter, power sensor or spectrum analyzer. For long cable XYZ antenna operation, the antenna may be used with a short coaxial cable to an RF preamplifier and a long coaxial cable to the receiver. The XYZ antenna does not require balun transformers or matching circuit components. A short feed source cable is used to connect 50 ohm input devices such as preamplifiers, power amplifiers and fixed power attenuators.

The three XYZ whips have no active components. They do have a three-dimensional vector field that combines the RF energies of three rods and increases the overall signal level input to a transceiver. That is, the XYZ radiator antenna according to the invention will provide improved gain when compared to a dipole antenna signal by receiving from space three radiated energy signals and combining them into one coherent isotropic radiator point source. The plane dipole antenna only receives part of the energy radiated from the isotropic radiator antenna. Identical antennas are required to maximize energy transfer and the XYZ isotropic radiator polarization type radiation according to the invention produces spherical coherent waves and maximizes energy transfers.

While the preferred forms and embodiments of the invention have been illustrated and described, it will be apparent to those of ordinary skill in the art that various changes and modifications may be made without deviating from the inventive concepts set forth above.

What is claimed is:

1. An antenna, comprising (a) a housing having lateral, longitudinal and vertical axes each of which is arranged 90 degrees perpendicular to each other;

(b) a plurality of whips connected with said housing and extending along said axes, respectively, said whips having conductors which are connected within said housing, whereby when the antenna is in transmission mode, a point source is defined in said housing where the conductors are connected and when the antenna is in a receiving mode, the whips combine to produce an RF output signal.

2. An antenna as defined in claim 1, wherein each of said whips generates a radiation pattern spaced from said housing, each field having a toroidal configuration.

3. An antenna as defined in claim 2, wherein said electromagnetic fields from said whips combine to form a radiation pattern having a heliocentric spherical configuration with a directivity of one, the center of said heliocentric spherical radiation pattern being arranged within said housing where said whip conductors are connected.

4. An antenna as defined in claim 1, and further comprising RF connectors mounted on said housing at 90 degree angles relative to each other, said whips being connected with said connectors, respectively.

5. An antenna as defined in claim 4, and further comprising a shielded cable connected with said housing for transmitting said RF output signal to a transceiver.

6. An antenna as defined in claim 5, wherein the length of each of said whips is determined by the resonance of the antenna when the antenna is in a state of electrical balance.

7. An antenna as defined in claim 4, and further comprising a single feed source connected with said housing, said antenna transmitting a three-dimensional polarization type radiation pattern from said source.

* * * * *